US005624058A

United States Patent [19]

Bailey

[11] Patent Number: 5,624,058

[45] Date of Patent: Apr. 29, 1997

[54] APPARATUS FOR PUMPING A SLURRY

[75] Inventor: Marshall G. Bailey, Banchory, United Kingdom

[73] Assignee: Rig Technology Limited, Aberdeen, Scotland

[21] Appl. No.: 433,433

[22] PCT Filed: Nov. 5, 1993

[86] PCT No.: PCT/GB93/02287

§ 371 Date: May 3, 1995

§ 102(e) Date: May 3, 1995

[87] PCT Pub. No.: WO94/10448

PCT Pub. Date: May 11, 1994

[30] Foreign Application Priority Data

Nov. 5, 1992 [GB] United Kingdom ..... 9223239

[51] Int. Cl.[6] ..... F04B 15/02

[52] U.S. Cl. ..... 222/240; 417/900; 222/318

[58] Field of Search ..... 417/900, 430, 417/424.1, 424.2; 415/121.1; 222/227, 239, 240, 318

[56] References Cited

U.S. PATENT DOCUMENTS

| | | | |
|---|---|---|---|
| 2,933,045 | 4/1960 | Isserlis . | |
| 3,171,658 | 3/1965 | Clark | 222/240 |
| 4,167,248 | 9/1979 | Akazawa et al. | 222/227 |
| 4,531,892 | 7/1985 | Näsman et al. | 417/900 |
| 4,842,479 | 6/1989 | Dorsch | 415/121.1 |
| 5,122,038 | 6/1992 | Malkoski | 417/900 |

FOREIGN PATENT DOCUMENTS

| | | | |
|---|---|---|---|
| 0682671 | 8/1979 | U.S.S.R. | 417/424.1 |

*Primary Examiner*—John J. Vrablik
*Assistant Examiner*—William Wicker
*Attorney, Agent, or Firm*—Lee, Mann, Smith, McWilliams, Sweeney & Ohlson

[57] ABSTRACT

An apparatus for the transportation and slurrying of cuttings from an oil well or drilling rig is taught comprising a vessel and a vertical shaft type centrifugal pump located below the vessel. Paddles or similar blades are mounted on the shaft to agitate the slurry during pumping. Means for recirculating part of the exiting slurry through a control valve and into the top of the vessel are included.

3 Claims, 3 Drawing Sheets

APPARATUS FOR PUMPING A SLURRY

BACKGROUND OF THE INVENTION

Systems for the transport and slurrying of cuttings on an oil well or drilling rig normally comprise:

1. A conveying system (1) to transport the cuttings from the point of discharge of the cuttings from the liquid/solids separation equipment (2) to a slurrying tank. Conveyors are normally of a screw of drag chain type, or conveying can be in a fluid stream.
2. A slurry tank (3) agitated by an agitator (4) into which the cuttings are discharged and mixed with the slurrying fluid.
3. A pump (5) provided with a gland or seal (6) for transporting the slurry (7) to the processing equipment or for transfer to storage.

The above prior art system is generally represented in FIG. 1 of the accompanying drawings.

Disadvantages of the above system include its space, weight, and relative complexity, the control required, the cost of manufacturing, the tendency for solids to settle and/or block the pump suction pipework (8), and the buildup in areas of lower agitation.

In the invention described hereinafter the disadvantages listed above are removed or at least reduced, giving advantages in size, weight, complexity, operability and/or efficiency of operation.

SUMMARY OF THE INVENTION

According to the present invention there is provided apparatus for pumping a slurry comprising a vessel serving as a reservoir for slurry and having an upper inlet and a lower outlet, and a pump having a rotatable pumping element situated in the outlet with the axis of rotation of the element substantially vertical.

Preferably the rotatable element is an impeller secured to a shaft and the pump is a centrifugal pump.

Preferably the pump shaft extends upwardly into the vessel and a paddle or like blade is secured thereto for agitating the slurry in the vessel as the pump impeller is rotated.

Thus the present apparatus comprises a combined agitated vessel and pumping assembly.

A vertical drive shaft supported by bearings, and driven by a suitable prime mover (e.g. an electric motor), may be arranged within a tank assembly. The prime mover may be variable or fixed speed.

The lower end of the tank may be coupled to a centrifugal pump casing. The impeller of the centrifugal pump is preferably fitted to the lower end of the vertical drive shaft. The vertical drive shaft is fitted with blades positioned such that the blades will agitate fluid resident in the tank assembly through which it runs.

BRIEF DESCRIPTION OF THE DRAWINGS

The invention will now be described, by way of example only, with reference to the accompanying drawings in which.

DESCRIPTION OF EMBODIMENTS

Figure 1:
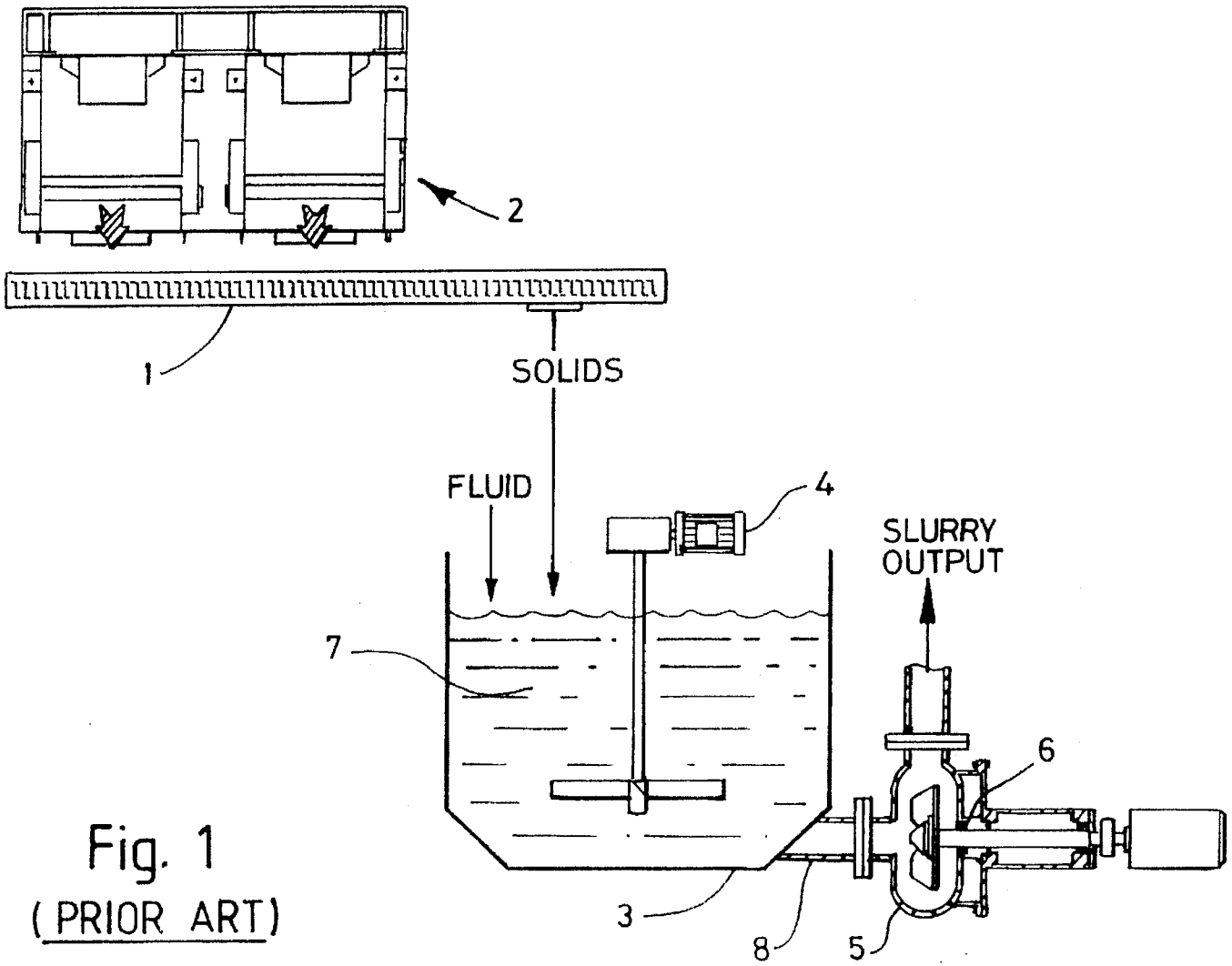
Fig. 1 (PRIOR ART)
FIG. 1 is a side view of an apparatus according to the invention for preparing a slurry.
Figure 2:
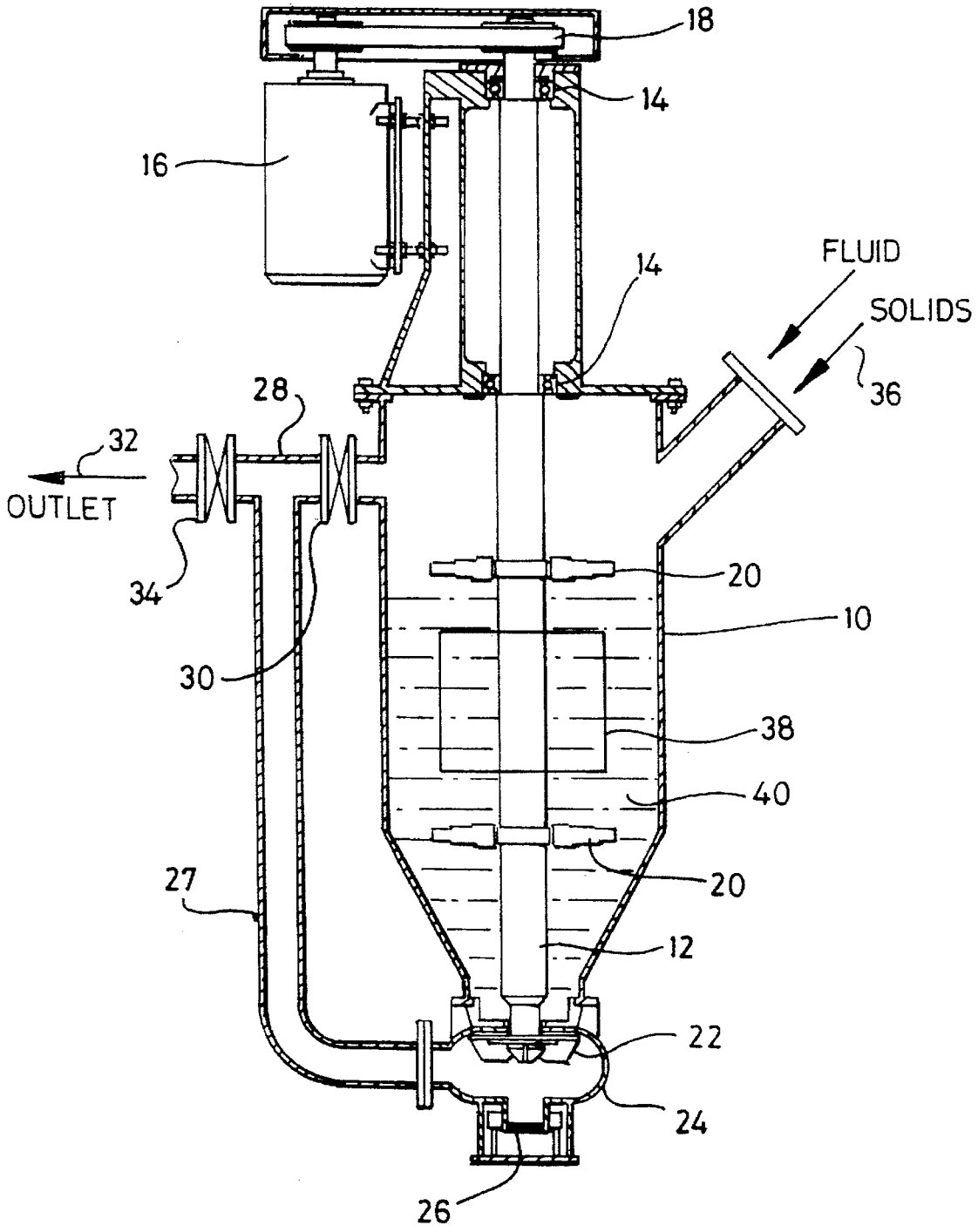
FIG. 2 is a side view in section of the first embodiment of the invention.

Referring first to FIG. 2 there is shown a generally a cylindrical vessel 10 in which is rotatably mounted a vertical drive shaft 12. The shaft 12 is supported in bearings 14 and driven by a drive motor 16 via a belt and pulley arrangement 18.

The shaft carries upper and lower agitator blades 20, and at its lowermost end is fitted with a centrifugal impellor 22 operable in a casing 24 of a pump assembly, whose bottom inlet 26 is blanked off.

The outlet of the casing 24 is connected to a pipe 27 which leads to a T-piece 28. One side of the T-piece is connected by a recirculating control valve 30 to the upper part of the vessel 10, while the other side leads to an outlet 32 via an outlet control valve 34.

An inclined inlet 36 for fluid/solids is disposed at the upper end of the vessel opposite the valve 3C. The vessel is also provided with a hatch 38 to permit access thereto when the vessel is empty.

The apparatus shown operates as follows:

Fluid is introduced into the vessel 10 and agitated by the blades 20 affixed to the vertical drive shaft 12. Solids are introduced through the inlet 36 into the vessel either separately or together with fluid. On entering the vessel the solids are mixed with the fluid to form a slurry 40. The solids and fluid slurry pass down through suitable flow ports from the vessel 70 into the pump casing 24. The slurry is then pumped forward either with the total flow passing through the outlet 32 to a downstream process equipment (not shown), or with part of the flow passing to the process equipment and part being recirculated through the control valve 30 to the vessel 10 (or alternatively being passed through a flow circuit (not shown) to transport cuttings from a solids separation equipment to the vessel).

As the solids build up in the fluid, the viscosity of the slurry 40 increases and the pumpability of the slurry reduces. To maintain the slurry in a pumpable form, a balance is required between fluid additions, the volume of slurry passed forward for further process and/or storage, and the volume of solids added.

A further advantage of the apparatus above described is the pumping characteristics and performance of the pumping. Where a horizontally mounted centrifugal pump is used, and air or gas is allowed to reach the pump suction, the pump may "gas lock". When gas locked, no pumping will occur until either a significant head of fluid is imposed above the pump suction to force the gas trapped in the pump casing through the pump, or the pump is stopped to allow the trapped gas to be displaced by fluid. This tendency of a centrifugal pump to gas lock results in the need for control of the fluid level in the feed tank to prevent gas entering the pump suction, if continuous pumping is required. A feature of the present invention is the avoidance of gas locking.

In the arrangement described in FIG. 2 the pump suction may be allowed to pump the vessel 10 empty and pumping will be resumed on re-introduction of fluid into the vessel, without the need to either stop the pump or impose a significant head of fluid above the suction of the pump. Further, because no seals or glands are required between the pump shaft and its casing 24, the pump may be run dry without damaging the assembly. The need to maintain the seals or glands is also consequently eliminated. The self-priming nature of the pump thus offers a significant advantage over a conventional pumping arrangement by eliminating the need for control equipment and operability restraints.

The self-priming characteristics of the pump also allows the pump to be applied to pump low volumes of fluid. The fluid volume pumped may be controlled by the volume of liquid fed to the vessel. A second embodiment of the invention is shown in FIG. 3

The vessel here is in the form of a hopper 30; and the pump comprises an immpellor 32 fitted to a vertical shaft 34 extending past a gland/seal 36 through a pump casing 38, with the motor 40 being mounted therebelow. An exit 42 for the slurry in the hopper is provided to one side of the impeller 32.

This arrangement uses a conventional centrifugal pump mounted with its drive shaft 34 in a vertical position below. Although this arrangement functions similarly to the apparatus of FIG. 2, it lacks the advantage of elimination of the seal and/or gland arrangement between the drive shaft and the pump, and the agitation provided within the vessel by the blades fixed to the drive shaft. Where however the feed vessel is short, such as may be the case when a short feed hopper only is fitted, and/or where the installation must be very compact, the above disadvantages are outweighed by the advantages.

Figure 3:
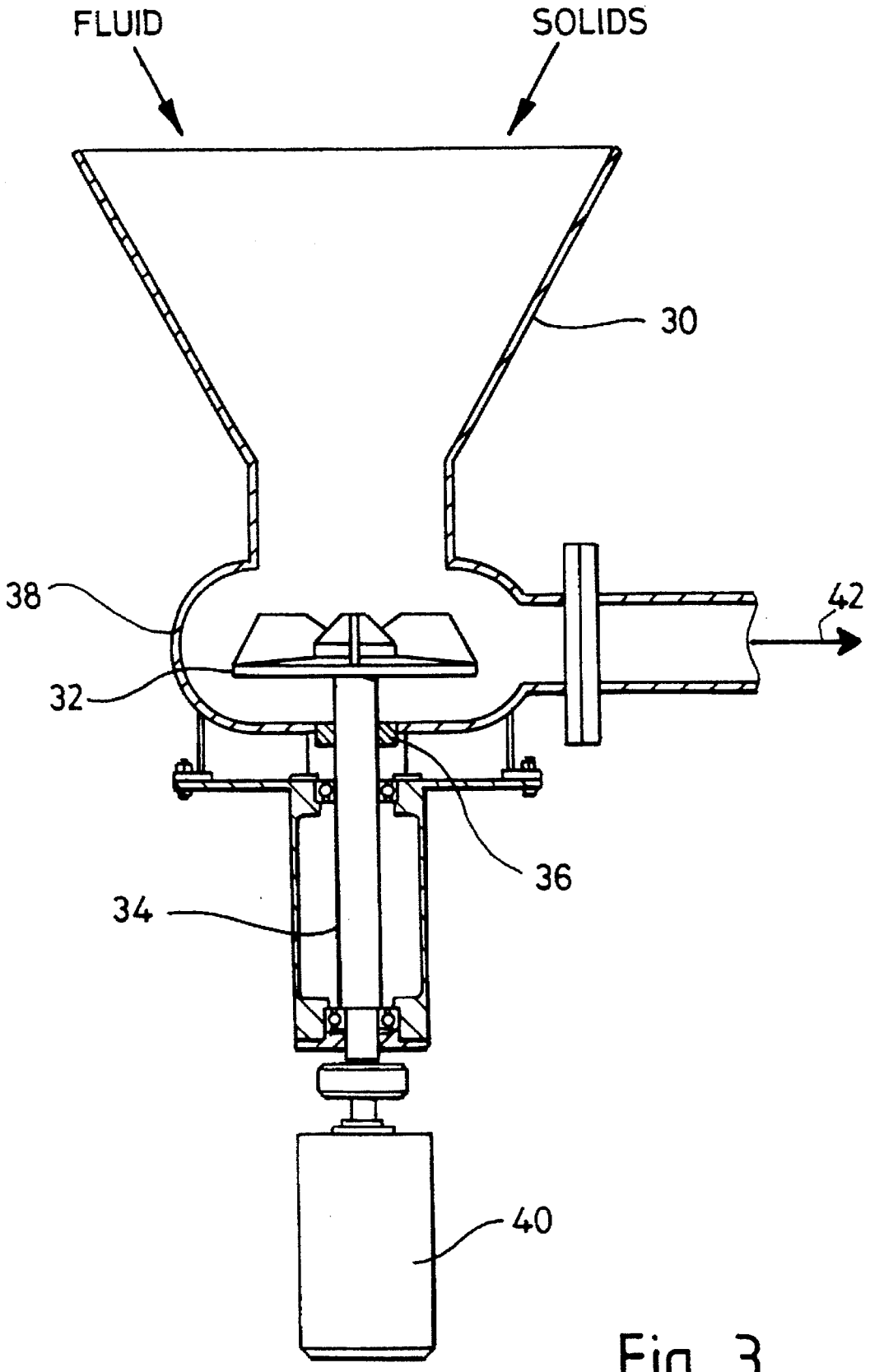
FIG. 3 is a side view in section of a second embodiment.

The arrangement shown in FIG. 3 is particularly advantageous in acting as a mixing means to transport cuttings in a fluid slurry from the liquid/solids separation equipment, or from a point of mixing to a downstream process. Whereas the transport of cuttings in a screw conveyor or drag chain conveyor is often expensive and inflexible, the transport of cuttings in a fluid gives the advantage of extreme flexibility and ease of installation.

In the arrangement described in FIG. 3 cuttings of mud chemicals are fed directly into the pump suction and mixed with fluid. The action of the pump serves to both slurry the cuttings or chemicals into the fluid, and to pump the slurry. This arrangement does not suffer from gas lock, and the pumping performance characteristics of the arrangement are such that the volume pumped is controlled by the volume introduced into the pump, and as long as a certain upper limit is non exceeded, the arrangement is ideal for the slurrying and transport of cuttings and/or mud chemicals.

In the two embodiments described the drive motor may be either of fixed or variable speed. The advantage of variable speed is the ability to match the pumping and agitation capacity of the arrangement, which varies with speed, to the particular application required.

I claim:

1. Apparatus for pumping a slurry, comprising a vessel serving as a reservoir for slurry and having an upper inlet and a lower outlet, and a centrifugal pump having a vertical shaft and a rotatable pumping impeller secured to the shaft and situated in the vicinity of the outlet, wherein the pump shaft extends downwardly into the vessel, and paddle means is drivingly secured thereto above the impeller for agitating the slurry in the vessel as the pump impeller is rotated, and further including means for recirculating part of the exiting slurry through a control valve and into the top of the vessel.

2. Apparatus according to claim 1 in which the shaft is a vertical drive shaft supported by bearings and driven by a prime mover.

3. Apparatus according to claim 2 in which the prime mover operates at variable speed.

* * * * *